US011012804B1

(12) United States Patent
Donley et al.

(10) Patent No.: US 11,012,804 B1
(45) Date of Patent: May 18, 2021

(54) CONTROLLING SPATIAL SIGNAL ENHANCEMENT FILTER LENGTH BASED ON DIRECT-TO-REVERBERANT RATIO ESTIMATION

(71) Applicant: Facebook Technologies, LLC, Menlo Park, CA (US)

(72) Inventors: Jacob Ryan Donley, Kirkland, WA (US); Paul Thomas Calamia, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/847,517

(22) Filed: Apr. 13, 2020

(51) Int. Cl.
*H04S 7/00* (2006.01)

(52) U.S. Cl.
CPC ..... *H04S 7/306* (2013.01)

(58) Field of Classification Search
None
See application file for complete search history.

(56) References Cited

U.S. PATENT DOCUMENTS

2019/0080709 A1* 3/2019 Wolff ..... H04R 5/027

* cited by examiner

*Primary Examiner* — Kenny H Truong
(74) *Attorney, Agent, or Firm* — Fenwick & West LLP

(57) ABSTRACT

An audio system for adaptively adjusting spatial sound signal enhancement filter lengths based on estimated direct-to-reverberant ratio (DRR) values. In response to detecting sound waves, sensors in a client device, such as a headset worn by a user, generate audio signals. The audio signals are analyzed to estimate the DRR values associated with the location. A value of a spatial signal enhancement filter length is obtained based on a model. The obtained spatial signal enhancement filter length is used to generate filters for filtering audio signals and generating audio content that are to be provided to an audio system of the headset for audio playback to the user.

20 Claims, 6 Drawing Sheets

CONTROLLING SPATIAL SIGNAL ENHANCEMENT FILTER LENGTH BASED ON DIRECT-TO-REVERBERANT RATIO ESTIMATION

FIELD OF THE INVENTION

This disclosure relates generally to presentation of audio content, and more specifically to controlling spatial signal enhancement filter length based on direct-to-reverberant ratio estimation.

BACKGROUND

In an artificial reality environment, simulating sound propagation from a sound source to a listener may use knowledge about acoustic properties of the location, including the direction-to-reverberant ratio associated with the location. When sound is produced in a reverberant location, it is difficult for a sensor array to separate spatially diffuse sound waves. Spatial signal enhancement filters are useful for audio signal enhancement as these filters leverage spatial diversity in the sound waves caused by the location to generate enhanced audio signals based on the sound waves, with longer filters improving audio quality of the enhanced audio signals. However, longer filters use more power, and furthermore, they may produce limited improvement as the sound waves attenuate. Therefore, improved technologies are needed for determining suitable spatial signal enhancement filter lengths.

SUMMARY

Spatial signal enhancement filters leverage spatial diversity in sound waves produced in a reverberant location to generate enhanced audio signals, with longer filters improving audio quality in the audio signals subsequently provided for audio playback to a user. Embodiments of the present disclosure support a method, computer readable medium, and system for generating spatial signal enhancement filters of suitable length to facilitate presentation of audio content (e.g., via an audio output system on a client device such as a headset worn by a user).

In some embodiments, an audio signal is received from a sensor array. A direct-to-reverberant ratio (DRR) value is estimated based on the received audio signal. The estimated DRR value is used to obtain a length of a spatial signal enhancement filter. A spatial signal enhancement filter is adjusted to have the obtained length. Audio content is provided to a user, where the audio content is partly based on the adjusted spatial signal enhancement filter.

In some embodiments, the length of the spatial signal enhancement filter based on the estimated DRR value is obtained using a model that maps various DRR values to corresponding lengths of spatial signal enhancement filters. In some embodiments, the mapping between the estimated DRR values and the lengths of spatial signal enhancement filters is based on a signal enhancement filter performance metric. In some embodiments, when the estimated DRR value is associated with a first frequency band, a second DRR value may be estimated based on the received audio signal, where the second DRR value is associated with a second frequency band. In these embodiments, a second spatial signal enhancement filter length is obtained based on the second DRR value, and a second spatial signal enhancement filter is adjusted to have the obtained second spatial signal enhancement filter length. In these embodiments, the provided audio content to the user is also based in part on the adjusted second spatial signal enhancement filter, and the first frequency band and the second frequency band are within an auditory frequency band of a human. In some embodiments, adjusting the spatial signal enhancement filter to have the obtained spatial signal enhancement filter length comprises generating a spatial signal enhancement filter that has the obtained spatial signal enhancement filter length. In some embodiments, adjusting the spatial signal enhancement filter to have the obtained spatial signal enhancement filter length comprises updating a spatial signal enhancement filter based on the obtained value of the spatial signal enhancement filter length. In some embodiments, where the received audio signal is speech, the audio signal is enhanced using the adjusted spatial signal enhancement filter.

In some embodiments, responsive to changes in the audio signal, the spatial signal enhancement filter is adaptively adjusted with different spatial signal enhancement filter lengths. In some embodiments, the adaptive adjustment of the filter lengths provides faster generation of filtered audio content that meet a threshold performance metric value than generation of filtered audio content without performing the adaptive adjustment of filter lengths.

Figure 1A:
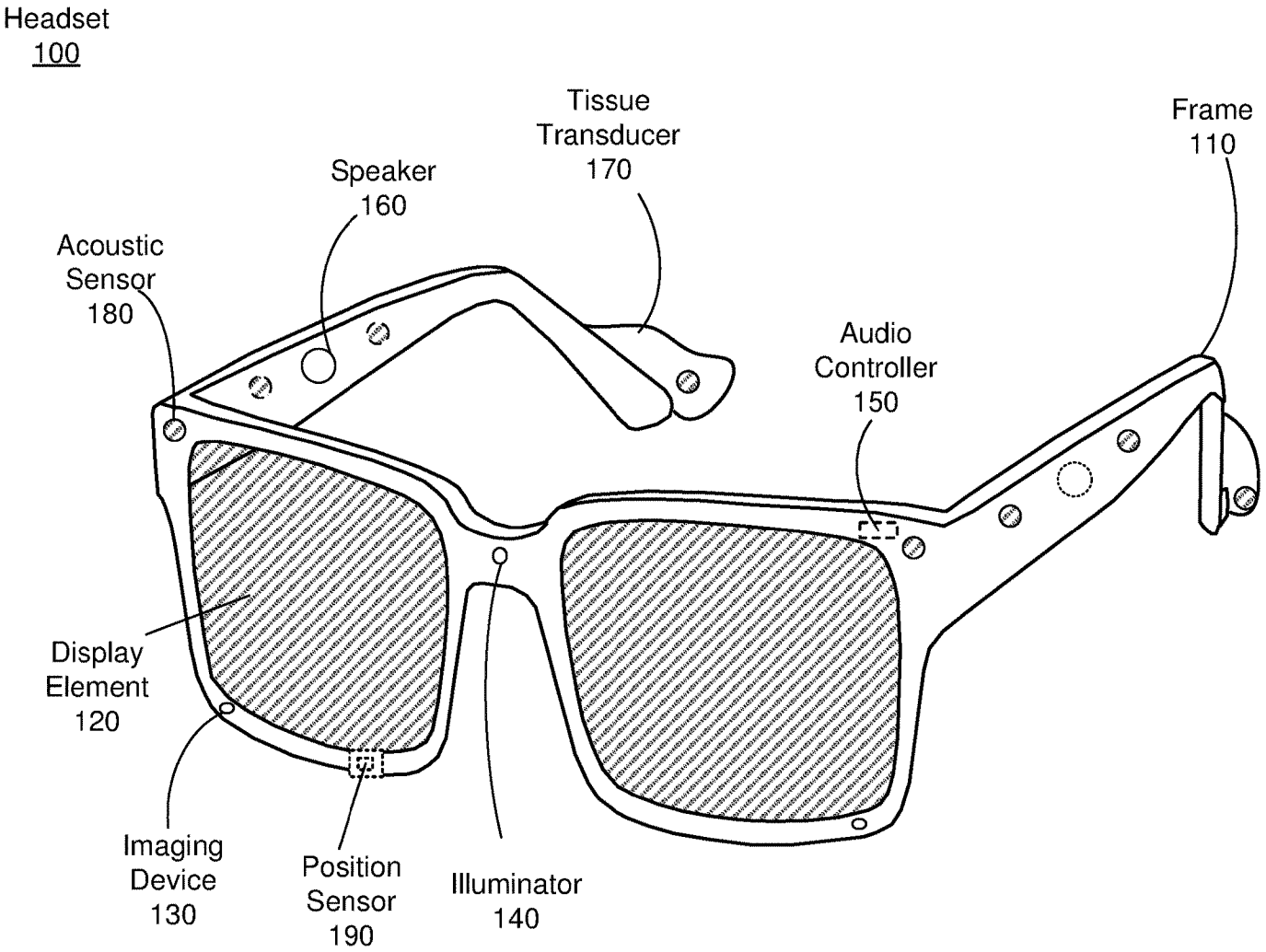
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An audio system may be located in a client device such as a headset worn by a user. A receiver such as a sensor array in the headset detects sound waves generated by one or more sound sources in a local area of the headset and generates audio signals based on the detected sound waves. The detected sound waves may be noisy and spatially diffuse as they arrive at the sensor array from multiple directions. The sound waves may travel a direct path from the sound source to the sensor array; the sound waves may also travel indirect paths and reflect off the surfaces in the room after exiting the sound source and before reaching the sensor array. In embodiments described herein, the indirect paths, also termed the reverberant paths for the sound waves, include the first order reflections from surfaces directly to the sensor array, as well as the higher order reflections where the sound waves bounce off several surfaces before reaching the sensor array. The indirect paths taken by the sound waves generate reverberation that affects the quality of the audio signals that are generated by the sensor array based on the detected sound waves.

The acoustic properties of the room can be related to direct-to-reverberant ratio (DRR) values associated with source and receiver locations for each frequency band in the generated audio signals. In some embodiments, a human auditory range of 20 Hz to 20 kHz may be chosen as a single frequency band. In some embodiments described herein, the generated audio signals within the human auditory range may be divided into a plurality of frequency bands with non-overlapping frequencies. The plurality of frequency bands chosen may be of the same range or of different ranges (e.g., smaller band-ranges at the more common mid-level frequencies, and greater band-ranges at the lower and higher ends of the human auditory range). In some embodiments, individual DRR values may be associated with individual frequency bands. Associating individual DRR values with individual frequency bands may provide improved processing for frequency ranges within audio signals that are more commonly encountered in particular scenarios. The DRR value for an individual frequency band is an acoustic parameter that is a function of location characteristics, such as the size of a room, reflective properties of surfaces in a room in which the sound source and the user are located, the distance between the sound source and the user, etc. As a user and/or a sound source moves from one location to another (e.g., through a doorway into another room) within the local area, the generated audio signals and the associated DRR values may change.

The audio system receives the generated audio signals from the sensor array. The audio signals are analyzed by the audio system for performing spatial signal enhancement. Spatial signal enhancement filters are useful for audio signal enhancement as they leverage the spatial diversity caused by the location(s) of the sound source(s) to enhance the audio signals. The length of a spatial signal enhancement filter, i.e., the number of taps in the time domain and/or frequency domain, influences performance of the filter. In a reverberant room, e.g., a spatial signal enhancement filter needs to be longer to separate spatially diffuse signals. However, while a longer spatial filter improves the audio quality, it does so at the expense of using more power. For signals that are attenuated more than a specified threshold, the benefits of lengthening a filter become limited. Furthermore, as a location associated with a sound source and/or a location associated with the user changes within the local area (e.g., when the sound source and/or the user move through a doorway into another room), the sound waves detected at the sensor array may change, resulting in changes in the audio signals received from the sensor array. The resulting changes in the DRR values because of changes in the audio signals may mean that lengths of the filters used to perform spatial signal enhancement of the generated audio signals may need to change to maintain a certain level of spatial signal enhancement.

In embodiments described herein, a model is developed to establish a correlation between the DRR values of a source/receiver location pair to various lengths of spatial signal enhancement filters. The correlation is established by leveraging a relationship between performance (e.g., signal-to-noise ratio (SNR) in the audio signals) and DRR values for each of the one or more frequency bands. The model provides a mapping of DRR values to lengths of spatial signal enhancement filters. This model may be generated at a server system and subsequently provided to an audio system in a client device such as a headset worn by a user, where it may be stored in association with the audio system. The stored model is subsequently used by the audio system to adjust spatial signal enhancement filter lengths based on the estimated DRR values for the one or more frequency bands associated with the location. Furthermore, in response to changes in the generated audio signals from the sensor array, the audio system adaptively adjusts spatial signal enhancement filters based on adjusted filter lengths as the audio signal changes.

In embodiments described herein, adaptively adjusted signal enhancement filters may be used to provide adaptively filtered audio content to the user. In some embodiments, a time difference and/or latency between a time of receiving the audio signal from the sensor array, and a time of providing the adaptively filtered audio content to the user, where the adaptively filtered audio content has a performance metric that meets a specified threshold range of a target value, is within a specified threshold time difference or latency value.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In some embodiments, the headset 100 may be a client device. In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents audio content to the user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate audio signals. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The audio controller 150 processes generated audio signals from the sensor array. In some embodiments, the processing involves estimating, for each of the one or more frequency bands, a DRR value associated with the location of the sound sources and of the user. The audio controller 150 uses the estimated DRR value in association with a stored model to obtain lengths for the spatial signal enhancement filters to be used by the sound filters in the audio controller 150. The audio controller 150 generates spatial signal enhancement filters of the obtained lengths. The audio controller 150 uses the generated spatial signal enhancement filters to modify the audio signals and generate enhanced audio signals that are provided as audio content for audio playback via the speakers 160. FIG. 3 depicts a process performed by the sound filter module 280 depicted in FIG. 2 for adaptively adjusting spatial signal enhancement filter lengths based on estimated DRR values for one or more frequency bands.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 7.

Figure 1B:
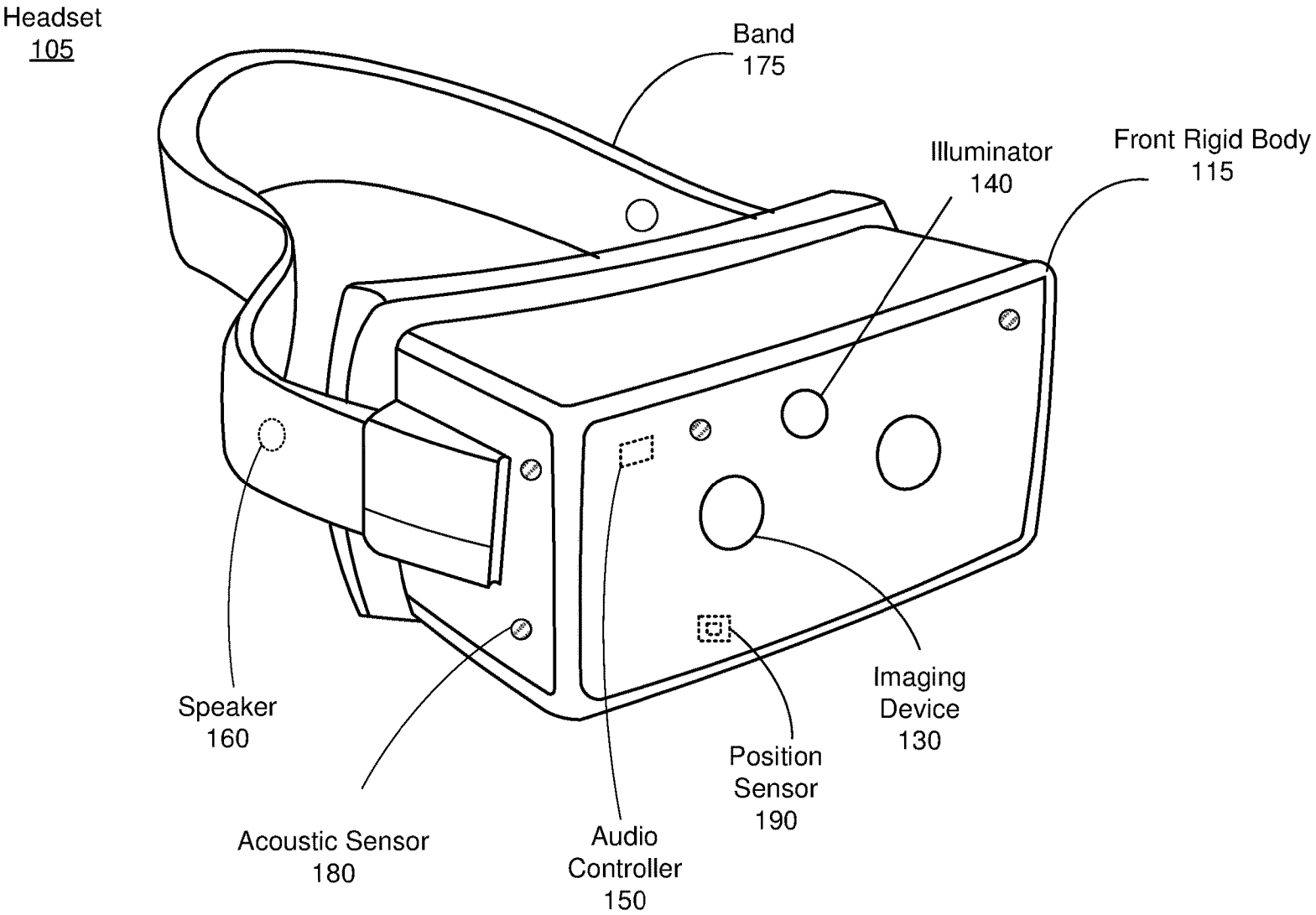
FIG. 1B is a perspective view of a headset implemented as a head-mounted display, in accordance with one or more embodiments.

FIG. 1B is a perspective view of a headset 105 implemented as a HMD, in accordance with one or more embodiments. In some embodiments, the headset 105 is a client device. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user.

Figure 2:
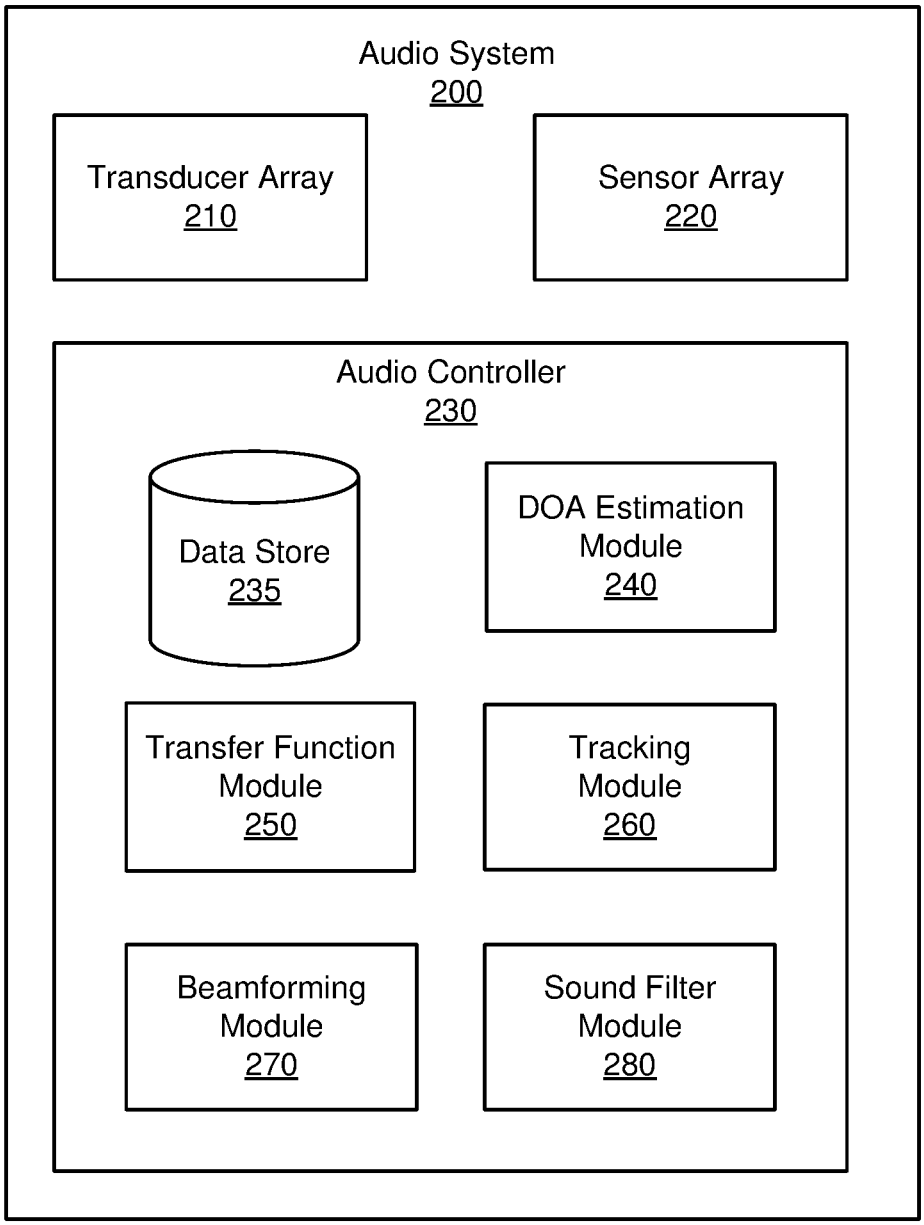
FIG. 2 is a block diagram of an audio system, in accordance with one or more embodiments.
Figure 3:
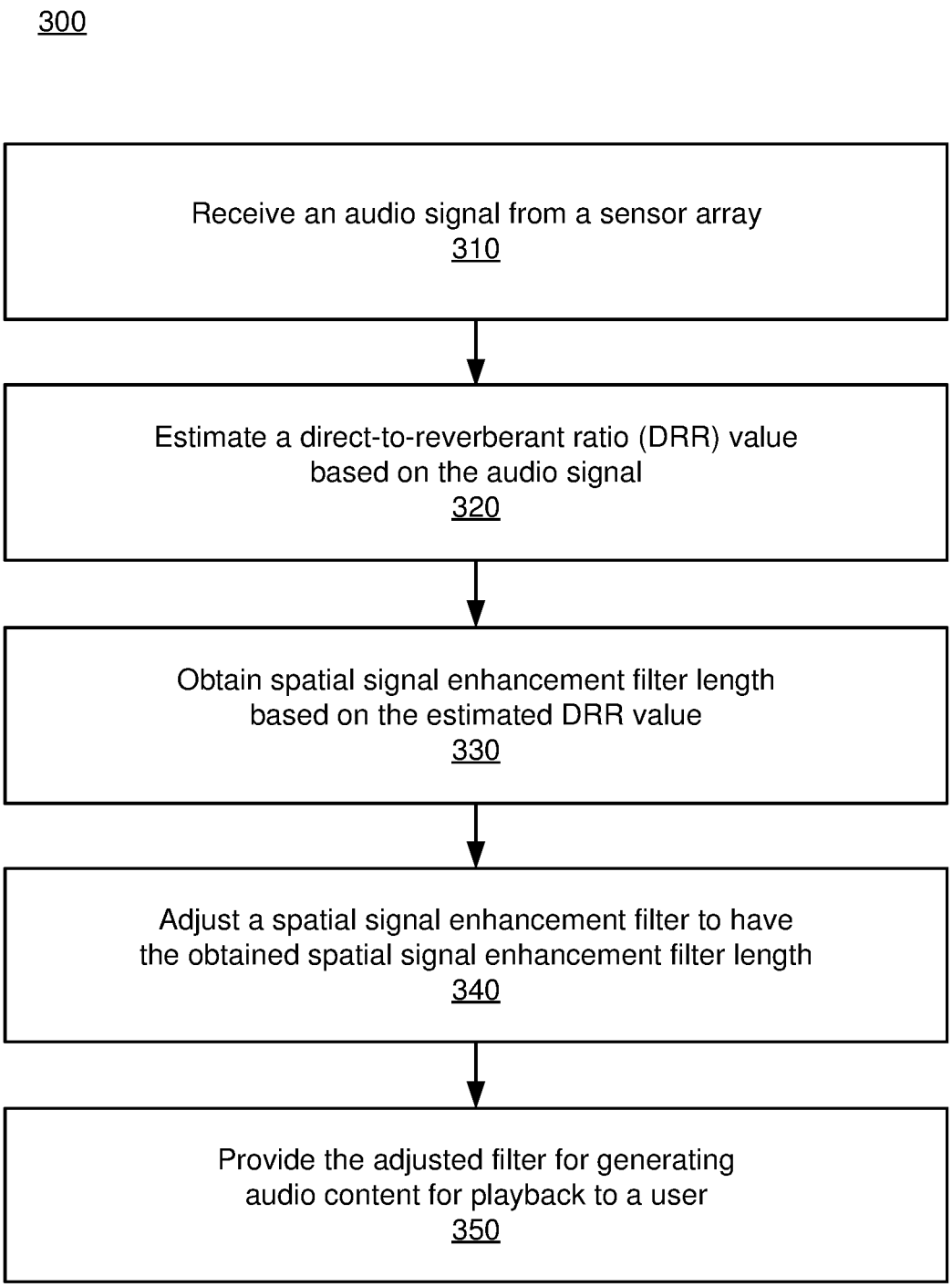
FIG. 3 is a flowchart illustrating a process for adjusting a length of a running spatial signal enhancement filter based on estimated DRR values, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, and a sound filter module 280. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset. The user may opt in to allow the audio controller 230 to transmit data captured by the headset to systems external to the headset, and the user may select privacy settings controlling access to any such data.

The data store 235 stores data for use by the audio system 200. Data in the data store 235 may include sounds recorded in the local area of the audio system 200, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, or any combination thereof. Data in the data store 235 may also include data that is received from an audio server (e.g., the audio server 400 in FIG. 4 and the audio server 525 in FIG. 7) for use by the audio system. In some embodiments, the data store 235 may store acoustic parameters that describe acoustic properties of the local area. The stored acoustic parameters may include, e.g., a reverberation time, a reverberation level, a room impulse response, etc. In some embodiments, the data in the data store 235 includes model information that is generated and provided by an audio server. The model information provides correlation data between DRR values and spatial signal enhancement filter lengths for one or more signal performance metrics and associated target values. In some embodiments, the model information may be in the form of a look-up table mapping the DRR values to spatial signal enhancement filter lengths for the one or more frequency bands.

The user may opt-in to allow the data store 235 to record data captured by the audio system 200. In some embodiments, the audio system 200 may employ always on recording, in which the audio system 200 records all sounds captured by the audio system 200 in order to improve the experience for the user. The user may opt in or opt out to allow or prevent the audio system 200 from recording, storing, or transmitting the recorded data to other entities.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, an audio server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 determines sound filters for the transducer array 210. In some embodiments, the sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 may generate spatial signal enhancement filters based on the calculated acoustic parameters to provide to the transducer array 210. In some embodiments, the sound filter module 280 may use model information provided by an audio server to obtain lengths for the spatial signal enhancement filters. In some embodiments, in generating the spatial signal enhancement filters, the sound filter module 280 may adaptively adjust lengths of the generated spatial signal enhancement filters based on continuous monitoring of an acoustic parameter such as the DRR value for the one or more frequency bands that is associated with the local area. This is further described below.

The sound filter module 280 may estimate DRR values of a location where a user wearing a headset is located. The DRR values may be estimated based on the audio signals generated at the sensor array for one or more frequency bands. The sound filter module 280 may use an algorithm for estimating the DRR values for the one or more frequency bands. Known algorithms for estimating the DRR values include algorithms described in "Dual-Channel Modulation Energy Metric for Direct-to-reverberation Ratio Estimation" by Sebastian Braun, João F. Santos, Emanuël A. P. Habets, and Tiago H. Falk (978-1-5386-4658-8/18 2018 IEEE), "Direct-to-Reverberant Ratio Estimation Using a Null-Steered Beamformer" by James Eaton, Alastair H. Moore, Patrick A. Naylor, and Jan Skoglund (978-1-4673-6997-8/15 2015 IEEE), and "Evaluating the Non-Intrusive Room Acoustics Algorithm with the Ace Challenge" by Pablo Peso Parada, Dushyant Sharma, Toon van Waterschoot, Patrick A. Naylor (ACE Challenge Workshop, IEEE-WASPAA 2015), etc. In some embodiments, the sound filter module 280 may also periodically estimate the DRR values to capture any changes in the DRR values due to changes in the audio signal (e.g., when the user or the sound source move about the location). In some embodiments, when a tracking module (e.g., the tracking module 260 depicted in FIG. 2) provides information about movement of a sound source or a change in the location information based on visual information received from the headset or some other external source, the sound filter module 280 may generate new estimates of the DRR values in response to the received information.

In some embodiments, the sound filter module 280 obtains lengths of spatial signal enhancement filters that correlate to the estimated DRR values for the one or more frequency bands. In some embodiments, the sound filter module 280 may obtain the lengths of the spatial signal enhancement filters in real time. In some embodiments, the sound filter module 280 obtains the filter lengths using a stored model in the audio system. In some embodiments, the stored model may be in the form of a look-up table that is stored in the data store (e.g., the data store 235 depicted in FIG. 2). In some embodiments, the stored model is generated by an audio server (e.g., the audio server 400 depicted in FIG. 4 and audio server 525 depicted in FIG. 5) and provided to the sound filter module 280.

The sound filter module 280 adjusts the lengths of spatial signal enhancement filters based on the obtained filter lengths for the estimated DRR values for one or more frequency bands. In some embodiments, the adjustment may involve generating spatial signal enhancement filters based on the obtained filter lengths. In some embodiments, the adjustment may involve updating lengths of previously generated running spatial signal enhancement filters based on the obtained filter lengths. In some embodiments, the sound filter module 280 may perform an iterative adjustment of the spatial filter lengths by iteratively (i) estimating the DRR values for one or more frequency bands, (ii) obtaining filter lengths for the estimated DRR values from a model, and (iii) adaptively adjusting the lengths of the spatial signal enhancement filters in real time based on the obtained filter lengths. In some embodiments, the sound filter module 280 may perform the iterative real-time adjustment of filter lengths by first choosing initial spatial filter lengths (e.g., prespecified default spatial filter lengths) as the filter lengths for individual frequency bands of the audio signal. The DRR values may then be repeatedly estimated based on the received audio signals, and used to adaptively adjust and refine filter lengths for one or more iterations based on the stored model.

The sound filter module 280 provides the generated sound filters of the adjusted lengths to the transducer array 210. In some embodiments, the sound filters may cause positive or negative amplification of sounds as a function of frequency. In some embodiments, the generated sound filters may be used by the transducer array 210 to generate filtered audio signals for the one or more frequency bands.

FIG. 3 is a flowchart of a method 300 of using a sound filter, in accordance with one or more embodiments. The process shown in FIG. 3 may be performed by components of a sound filter (e.g., sound filter module 280 located in the audio system 200 depicted in FIG. 2). Other entities may perform some or all of the steps in FIG. 3 in other embodiments. Embodiments may include different and/or additional steps, or perform the steps in different orders.

The sound filter receives 310 audio signals generated by the sensor array (e.g., the sensor array 220 depicted in FIG. 2). The received signals are provided by the audio system to the sound filter. The sensor array may be part of a sensor array located in, for example, a headset or an NED that is worn by a user at a location.

The sound filter estimates 320 DRR values associated with the location for one or more frequency bands based on the received audio signals. The DRR values are estimated using one or more of known DRR estimation algorithms. In some embodiments, the sound filter estimates 320 DRR values at a location periodically to capture any changes in the DRR values as the audio signals change (e.g., as the user or the sound source moves about the location). In some embodiments, the sound filter may receive information about movement of a sound source or a change in the location information based on visual information (e.g., received from the headset or some other external sources). In these embodiments, the sound filter may generate new estimates of the DRR values upon receipt of the tracking or movement information.

The sound filter obtains 330 lengths of spatial signal enhancement filters that correlate to the estimated DRR values for the one or more frequency bands. In some embodiments, the sound filter may obtain 330 the lengths of the spatial signal enhancement filters in real time. In some embodiments, the sound filter module 280 obtains the filter lengths from a stored model in the data store, such as e.g., a look-up table. In some embodiments, the stored model establishes a correlation between DRR values for the one or more frequency bands and the lengths of spatial signal enhancement filters. The established correlation is based on a signal enhancement filter performance metric. In some embodiments, the correlation establishes, for each DRR value for the one or more frequency bands, a corresponding length of the spatial signal enhancement filter. In some embodiments, the established corresponding length of a filter for a DRR value is the filter length for which the performance metric value of the signal enhancement filter is within a specified threshold range of a target signal enhancement performance metric value. In some embodiments, the signal enhancement filter performance metric is associated with an SNR value of the filtered audio signal generated by the filter.

The sound filter adjusts 340 the spatial signal enhancement filters to have the obtained filter lengths for the one or more frequency bands. In some embodiments, the adjustment may involve generating spatial signal enhancement filters based on the obtained filter lengths. In some embodiments, the adjustment may involve updating lengths of previously generated spatial signal enhancement filters based on the obtained filter lengths. In some embodiments, the adjusting may be performed iteratively by (i) estimating the DRR values for one or more frequency bands, (ii) obtaining filter lengths for the estimated DRR values from a stored model, and (iii) adaptively adjusting the lengths of the spatial signal enhancement filters in real time based on the obtained lengths. In some embodiments, adjusting may be performed in real-time by first choosing initial spatial filter lengths (e.g., prespecified default spatial filter lengths) for running spatial signal enhancement filters, and iteratively estimating DRR values, obtaining the filter lengths for the estimated DRR values, and generating or updating filter lengths of the running filters.

The sound filter provides 350 the generated or updated spatial signal enhancement filters to the transducer array for performing filtering of the received audio signals to generate audio content for playback to the user.

Figure 4:
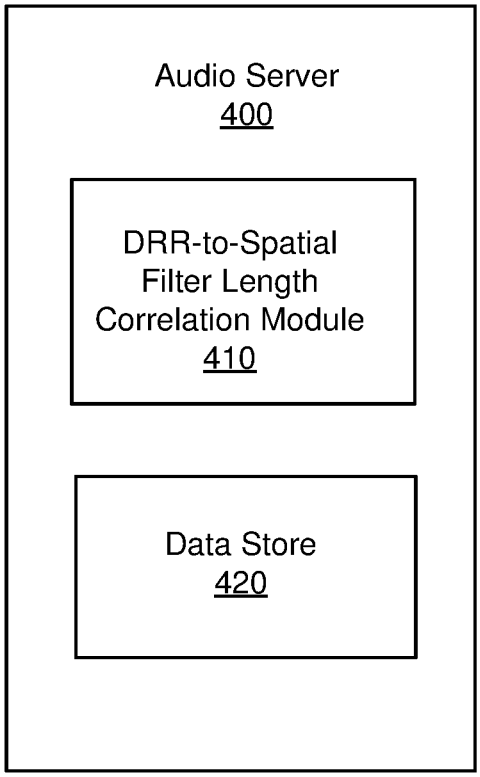
FIG. 4 is a block diagram of an audio server module, in accordance with one or more embodiments.

FIG. 4 is a block diagram of audio server 400, in accordance with one or more embodiments. The audio server 400 generates a model that maps DRR values for one or more frequency bands to corresponding spatial signal enhancement filter lengths. The audio server 400 may also transmit the model to an audio system (e.g., the audio system 200 in FIG. 2 and the audio system 550 in FIG. 5) for storage and use by the audio system. In the embodiment depicted in FIG. 4, the audio server 400 includes a DRR-to-spatial filter length correlation module 410 and a data store 420. Some embodiments of the audio server 400 may have different components than those described here. Similarly, in some cases, functions can be distributed among the components in a different manner than is described here.

The DRR-to-spatial filter length correlation module 410 generates a model that establishes the correlation between DRR values and spatial signal enhancement filter lengths for one or more frequency bands. The module 410 selects DRR values that are associated with various scenarios in which a headset may operate. For example, the scenarios may represent different sizes of a local area (e.g., a concert-sized hall, a small room, etc.), multiple material properties of the local area (e.g., carpeted, tiled, etc.), a range of sound source locations and sound receiver locations within the local area (e.g., as a sound source and a sound receiver get closer, the DRR values become higher), or some combination thereof. In some embodiments, the module 410 may use available public data sets of DRR values for various scenarios. In some embodiments, the model is generated by mapping each of the selected DRR values to a corresponding spatial signal enhancement filter length for one or more frequency bands. For example, in some cases there may be a single DRR that is mapped to a single spatial signal enhancement filter length irrespective of frequency. In other embodiments, there may be different DRRs for different frequency bands (e.g., low audio frequencies, mid-range audio frequencies, and high audio frequencies), and the model maps each of the DRRs to corresponding spatial signal enhancement filters for that respective audio band. In some embodiments, the model is a function that calculates a signal enhancement filter length given a particular DRR. In other embodiments, the model is one or more look up tables which map DRR values to corresponding spatial signal enhancement filter lengths.

In some embodiments, simulation studies are used to determine spatial signal enhancement filters for DRRs. The determined spatial signal enhancement filters may be used to generate and/or update the model. The simulation studies may perform computer simulations that calculate DRRs at one or more frequency bands for various scenarios (e.g., room shapes, room materials, sound source location, user location, etc.). In some embodiments, the simulation may generate audio signals over a range of frequencies in the human auditory range to correspond to detected sound waves in each of the simulated DRR scenarios. The generated audio signals may be filtered using spatial signal enhancement filters of various filter lengths to determine filter lengths that provide performance metric values that are within a specified threshold of a target performance metric value. The model may be generated to correlate filter lengths to DRR values over the range of frequencies based on one or more performance metrics.

In some embodiments, empirical information may be used (e.g., by the module 410) to train machine learning and/or deep learning models, such as classification models, regression models, reinforcement models, neural networks, encoder/decoder models such as auto-encoders, etc., to establish the correlation between DRR values and spatial signal enhancement filter lengths. In these embodiments, DRR values and empirically determined filter lengths may be used to train the model.

For of the scenarios used to generate and/or update the model, one or more signal enhancement performance metrics may be pre-established. For example, a chosen signal enhancement performance metric may be SNR values of the filtered audio signal. The SNR values may be determined for each of a range of spatial filter lengths in association with a particular DRR value (i.e., for the particular scenario) for the one or more frequency bands. A target performance metric value, such as a target SNR value or a measure of increase in SNR, such as a target SNR Improvement or Array Gain, or measures of signal enhancement sensitivity and white noise gain (WNG) may be pre-specified for use in determining filter lengths. For example, with a pre-specified target SNR value, for a particular scenario (i.e., with particular DRR values for each of the one or more frequency bands), the spatial filter lengths resulting in filtered audio signals with SNR values that are within a threshold of the target SNR value may be chosen as the filter length for the particular DRR for the frequency band. Thus, in embodiments herein, for each of a range of DRR values, spatial signal enhancement filters of a range of lengths are generated, and the corresponding signal enhancement performance metric values are determined. For each frequency band, the filter length resulting in the performance metric value that is within a threshold of the target performance value is chosen to be the filter length that is mapped to the DRR value for that frequency band in the generated model. In some embodiments, the DRR-to-spatial filter length correlation module 410 may update the model when new scenarios with new acoustic properties become known. In some embodiments, the DRR-to-spatial filter length correlation module 410 updates the generated model when correlation data corresponding to improved performance metric values is generated. The DRR-to-spatial filter length correlation module 410 stores the generated model table in the data store 430.

In some embodiments, the audio server 400 may transmit one or more embodiments of the generated model to an audio system that is located in a client device such as a headset or an NED system (e.g., audio system 200 in FIG. 2 and audio system 550 in FIG. 5) for storage in a data store associated with the audio system.

The data store 420 stores data generated by the audio server 400 as well as data for use by the audio server 400. Data in the data store 330 may include one or more embodiments of the model that is generated by the DRR-to-spatial filter length correlation module 410 and any other models that map DRR values to spatial signal enhancement filter lengths. Data in the data store 330 may also include data that is used for model generation, including simulation parameters, data related to scenarios, DRR values, filter lengths, performance metrics and related target and threshold values, etc. Other data in the data store 420 may include head-related transfer functions (HRTFs), transfer functions for one or more sensors, array transfer functions (ATFs) for one or more of the acoustic sensors, sound filters, and other data relevant for use by the audio server 400, or any combination thereof.

Figure 5:
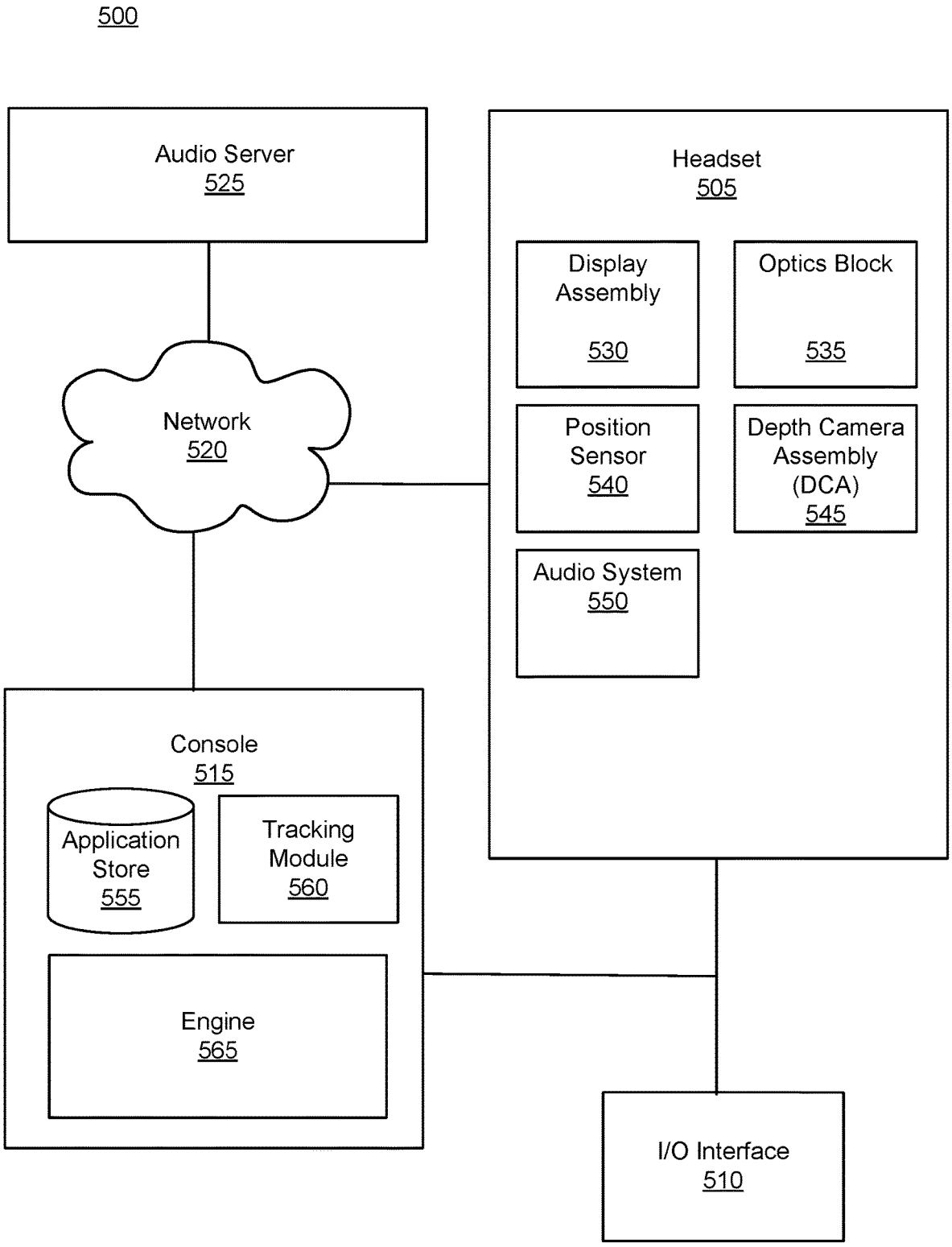
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. In some embodiments, the headset 505 may be a client device The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the audio server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is substantially the same as the audio system 200 describe above. The audio system 550 may comprise one or acoustic sensors, one or more transducers, and an audio controller. The audio system 550 may provide spatialized audio content to the user. In some embodiments, the audio system 550 may request some acoustic parameters from the audio server 525 over the network 520. The acoustic parameters describe one or more acoustic properties (e.g., room impulse response, a reverberation time, a reverberation level, filter length, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the audio server 525, and use the sound filters to provide audio content to the user. In some embodiments, when sound waves are detected at the headset 505, the audio system 550 generates audio signals based on the detected sound waves. A DRR value is then estimated based on the generated audio signals. The estimated DRR value is used to obtain, from a stored model in the audio system 550, a value for a length of a spatial signal enhancement filter such that a performance metric value of the spatial signal enhancement filter is within a threshold range of a specified performance metric value. The obtained length is used to adjust a length of a spatial signal enhancement filter used to subsequently generate audio content that is provided for audio playback to the user (e.g., via an audio output system in the headset 505).

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the audio server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The audio server 525 may include a database that stores a virtual model describing a plurality of spaces, wherein one location in the virtual model corresponds to a current configuration of a local area of the headset 505. The audio server may be an embodiment of the audio server 300 depicted in FIG. 3. The audio server 525 receives, from the headset 505 via the network 520, information describing at least a portion of the local area and/or location information for the local area. The user may adjust privacy settings to allow or prevent the headset 505 from transmitting information to the audio server 525. The audio server 525 determines, based on the received information and/or location information, a location in the virtual model that is associated with the local area of the headset 505. The audio server 525 determines (e.g., retrieves) one or more acoustic parameters associated with the local area, based in part on the determined location in the virtual model and any acoustic parameters associated with the determined location. The audio server 525 may transmit the location of the local area and any values of acoustic parameters associated with the local area to the headset 505.

In some embodiments, the audio server 525 generates a model that establishes the correlation between DRR values and spatial signal enhancement filter lengths for one or more frequency bands. The audio server 525 generates the model by selecting DRR values from a range of possible DRR values that are selected to represent a range of possible scenarios under which a headset 505 may operate. For each of the selected DRR values, for each of the one or more frequency bands, spatial signal enhancement filters of a range of lengths are generated, and the corresponding signal enhancement performance metric values are determined. For each frequency band, the filter length resulting in the performance metric value that is within a threshold of the target performance value is chosen to be the filter length that is mapped to the DRR value for that frequency band in the generated model. In some embodiments, the audio server 525 may transmit any embodiments of the generated model to the audio system 550 in the headset 505 for storage in a data store associated with the audio system 550.

One or more components of system 500 may contain a privacy module that stores one or more privacy settings for user data elements. The user data elements describe the user or the headset 505. For example, the user data elements may describe a physical characteristic of the user, an action performed by the user, a location of the user of the headset 505, a location of the headset 505, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 500 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

receiving an audio signal from a sensor array;

estimating a direct-to-reverberant ratio (DRR) value based on the received audio signal;

obtaining a spatial signal enhancement filter length based on the estimated DRR value;

adjusting a spatial signal enhancement filter to have the obtained spatial signal enhancement filter length; and providing audio content to a user, the audio content based in part on the adjusted spatial signal enhancement filter.

2. The method of claim 1, wherein obtaining the spatial signal enhancement filter length based on the estimated DRR value comprises using a model that maps various DRR values to corresponding lengths of spatial signal enhancement filters.

3. The method of claim 2, wherein a mapping between the estimated DRR values and the lengths of spatial signal enhancement filters is based on a signal enhancement filter performance metric.

4. The method of claim 1, wherein the estimated DRR value is associated with a first frequency band, the method further comprising:

estimating a second DRR value based on the received audio signal, the second DRR value associated with a second frequency band;

obtaining a second spatial signal enhancement filter length based on the estimated second DRR value; and adjusting a second spatial signal enhancement filter to have the obtained second spatial signal enhancement filter length, and wherein the audio content is also based in part on the adjusted second spatial signal enhancement filter, and the first frequency band and the second frequency band are within an auditory frequency band of a human.

5. The method of claim 1, wherein adjusting the spatial signal enhancement filter to have the obtained spatial signal enhancement filter length comprises generating a spatial signal enhancement filter that has the obtained spatial signal enhancement filter length.

6. The method of claim 1, wherein adjusting the spatial signal enhancement filter to have the obtained spatial signal enhancement filter length comprises updating a spatial signal enhancement filter based on the obtained value of the spatial signal enhancement filter length.

7. The method of claim 1, wherein the audio signal is speech, the method further comprising:

enhancing the audio signal using the adjusted spatial signal enhancement filter.

8. The method of claim 1, further comprising:

responsive to changes in the audio signal, adaptively adjusting the spatial signal enhancement filter with different spatial signal enhancement filter lengths.

9. The method of claim 8, further comprising:

providing adaptively filtered audio content to the user, the adaptively filtered audio content based in part on the adaptively adjusted spatial signal enhancement filter;

determining a time difference between:

a time of receiving the audio signal from the sensor array; and a time of providing the adaptively filtered audio content to the user, the adaptively filtered audio content having a value of a performance metric that is within a specified threshold range of a target value; and establishing that the determined time difference is within a specified threshold time difference.

10. A non-transitory computer-readable medium comprising computer program instructions that, when executed by a computer processor of an online system, cause the processor to perform steps comprising:

receiving an audio signal from a sensor array;

estimating a direct-to-reverberant ratio (DRR) value based on the received audio signal;

obtaining a spatial signal enhancement filter length based on the estimated DRR value;

adjusting a spatial signal enhancement filter to have the obtained spatial signal enhancement filter length; and providing audio content to a user, the audio content based in part on the adjusted spatial signal enhancement filter.

11. The non-transitory computer-readable medium of claim 10, wherein obtaining the spatial signal enhancement filter length based on the estimated DRR value comprises using a model that maps various DRR values to corresponding lengths of spatial signal enhancement filters.

12. The non-transitory computer-readable storage medium of claim 11, wherein a mapping between the estimated DRR values and the lengths of spatial signal enhancement filters is based on a signal enhancement filter performance metric.

13. The non-transitory computer-readable storage medium of claim 11, further comprising:

responsive to changes in the audio signal, adaptively adjusting the spatial signal enhancement filter with different spatial signal enhancement filter lengths.

14. The non-transitory computer-readable storage medium of claim 10, wherein the estimated DRR value is associated with a first frequency band, the method further comprising:

estimating a second DRR value based on the received audio signal, the second DRR value associated with a second frequency band;

obtaining a second spatial signal enhancement filter length based on the estimated second DRR value; and adjusting a second spatial signal enhancement filter to have the obtained second spatial signal enhancement filter length, and wherein the audio content is also based in part on the adjusted second spatial signal enhancement filter, and the first frequency band and the second frequency band are within an auditory frequency band of a human.

15. The non-transitory computer-readable storage medium of claim 10, wherein adjusting the spatial signal enhancement filter to have the obtained spatial signal enhancement filter length comprises generating a spatial signal enhancement filter that has the obtained spatial signal enhancement filter length.

16. The non-transitory computer-readable storage medium of claim 10, wherein adjusting the spatial signal enhancement filter to have the obtained spatial signal enhancement filter length comprises updating a spatial signal enhancement filter based on the obtained value of the spatial signal enhancement filter length.

17. A system comprising:

a sensor array configured to receive an audio signal;

an audio controller configured to:

estimate a direct-to-reverberant ratio (DRR) value based on the received audio signal;

obtain a spatial signal enhancement filter length based on the estimated DRR value;

adjust a spatial signal enhancement filter to have the obtained spatial signal enhancement filter length; and provide audio content to a user, the audio content based in part on the adjusted spatial signal enhancement filter.

18. The system of claim 17, wherein the audio controller is further configured to obtain the spatial signal enhancement filter length based on the estimated DRR value using a model that maps various DRR values to corresponding lengths of spatial signal enhancement filters.

19. The system of claim 18, wherein a mapping between the estimated DRR values and the lengths of spatial signal enhancement filters is based on a signal enhancement filter performance metric.

20. The system of claim 17, wherein the audio controller is further configured to, responsive to changes in the audio signal, adaptively adjust the spatial signal enhancement filter with different spatial signal enhancement filter lengths.

* * * * *